US007300563B2

(12) United States Patent
Diaddario, Jr.

(10) Patent No.: US 7,300,563 B2
(45) Date of Patent: Nov. 27, 2007

(54) USE OF N-ALLLYL SUBSTITUTED AMINES AND THEIR SALTS AS BRIGHTENING AGENTS IN NICKEL PLATING BATHS

(75) Inventor: Leonard L. Diaddario, Jr., Independence, OH (US)

(73) Assignee: Pavco, Inc., Charlotte, NC (US)

( * ) Notice: Subject to any disclaimer, the term of this patent is extended or adjusted under 35 U.S.C. 154(b) by 253 days.

(21) Appl. No.: 10/774,558

(22) Filed: Feb. 9, 2004

(65) Prior Publication Data

US 2004/0154928 A1 Aug. 12, 2004

Related U.S. Application Data

(60) Provisional application No. 60/445,612, filed on Feb. 7, 2003.

(51) Int. Cl.
*C25D 3/56* (2006.01)
*C25D 3/12* (2006.01)
*C23C 16/00* (2006.01)

(52) U.S. Cl. ..... 205/259; 205/271; 106/1.27

(58) Field of Classification Search ..... 205/259, 205/271; 106/1.27

See application file for complete search history.

(56) References Cited

U.S. PATENT DOCUMENTS

| | | | | |
|---|---|---|---|---|
| 2,876,177 A | | 3/1959 | Gündel | 204/49 |
| 3,133,006 A | * | 5/1964 | Ostrow et al. | 205/271 |
| 3,772,168 A | | 11/1973 | Dillenberg | 204/435 |
| 3,862,019 A | | 1/1975 | Rosenberg et al. | 204/49 |
| 4,054,495 A | | 10/1977 | Law et al. | 204/49 |
| 4,077,855 A | | 3/1978 | Popescu | 204/49 |
| 4,212,709 A | | 7/1980 | Patsch et al. | 204/49 |
| 4,435,254 A | | 3/1984 | Lemke | 204/49 |
| 5,438,140 A | | 8/1995 | Oftring et al. | 546/147 |
| 5,445,727 A | | 8/1995 | Schwendemann et al. | 205/271 |
| 5,606,067 A | | 2/1997 | Burkhart et al. | 546/347 |
| 5,611,906 A | | 3/1997 | Burkhart et al. | 205/271 |
| 5,840,096 A | | 11/1998 | Tajima et al. | 65/30.1 |

FOREIGN PATENT DOCUMENTS

| | | |
|---|---|---|
| GB | 1001957 | 8/1965 |
| GB | 1091197 | 11/1967 |
| GB | 1550168 | 8/1979 |

OTHER PUBLICATIONS

Lowenheim, Electroplating, c. 1978 (no month), pp. 205-220.*

* cited by examiner

*Primary Examiner*—Edna Wong
(74) *Attorney, Agent, or Firm*—Fay Sharpe LLP

(57) ABSTRACT

An aqueous acidic plating bath for the electrodeposition of a nickel or nickel alloy deposit. The bath includes nickel ions and an additive having the general formula:

$H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion.

20 Claims, No Drawings

USE OF N-ALLLYL SUBSTITUTED AMINES AND THEIR SALTS AS BRIGHTENING AGENTS IN NICKEL PLATING BATHS

This application claims priority under 35 U.S.C. §119(e) to provisional application 60/445,612, filed on Feb. 7, 2003.

FIELD OF THE INVENTION

The present invention relates to aqueous acid nickel electroplating solutions and a method for electroplating nickel coatings. Specifically, the invention relates to an acidic nickel electroplating solution including an additive that produces an extremely ductile, leveled and highly brilliant deposit.

BACKGROUND OF THE INVENTION

Nickel is one of the most important electrodeposited metals due to its excellent decorative and corrosion-resistance properties. Most nickel electrolyte systems are based on the Watts plating bath, which generally contains nickel sulfate, nickel chloride, and boric acid. Electroplating baths have been developed to produce ductile, low-stress, high leveling, semi-bright and bright nickel deposits. A multilayered nickel deposit, containing a sulfur-free semi-bright nickel layer with a sulfur-containing bright nickel layer, significantly improves corrosion protection.

A variety of organic compounds are used as brighteners in nickel baths to provide a bright, level, and ductile nickel deposit. Nickel brighteners are generally divided into two classes. Class I, or primary, nickel brighteners include compounds such as aromatic or unsaturated aliphatic sulfonic acids, sulfonamides, sulfonimides, and sulfimides. Class I brighteners are used in relatively high concentrations and produce a hazy or cloudy deposit on the metal substrate. Class I brighteners decompose during the electroplating process, and sulfur is incorporated into the deposit, which reduces the internal tensile stress of the deposit.

Class II, or secondary, nickel brighteners are used in combination with Class I brighteners to produce a fully bright and leveled nickel deposit. Class II brighteners are generally unsaturated organic compounds. A variety of organic compounds containing unsaturated functional groups such as aldehydic, olefinic, acetylinic, nitrite, and pyridine groups have been used as Class II brighteners. Typically, Class II brighteners are derived from acetylinic or ethylenic alcohols, ethoxylated acetylenic alcohols, coumarins and pyridine based compounds. Mixtures of such unsaturated compounds with mixtures of Class I brighteners are combined to obtain maximum brightness or ductility for a given rate of leveling. Class II brighteners, however, cause brittleness and increase internal stress in a deposit, and, therefore, cannot be used alone.

A variety of amine compounds have been reported as brightening or leveling agents. Several patents describe the use of acyclic amines as Class II brighteners that require the use of other Class I and Class II brighteners. U.S. Pat. No. 4,077,855 is directed to the use of olefinic or acetylenic sulfobetaines and carboxybetaines. U.S. Pat. Nos. 4,054,495 and 4,435,254 disclose the use of acetylenic amines in combination with acetylenic compounds as an effective brightener and leveling system. U.S. Pat. No. 5,840,986 describes the synthesis of N-alkyl-substituted aminoalkynes, which could potentially be used as a brightener in nickel baths.

Other patents disclose the use of single or multi ring nitrogen containing heterocyclic amines as Class II brighteners for bright nickel electroplating systems. U.S. Pat. Nos. 2,876,177 and 3,862,019 discuss the use of pyridine sulfobetaines. U.S. Pat. No. 4,212,709 expands on the pyridine-based brighteners to include mononuclear and polynuclear aromatic heterocyclic nitrogen bases. U.S. Pat. Nos. 5,438,140 and 5,45,727 describe the use of alkyl derivatives of nitrogen containing heterocycles as brighteners for nickel electroplating systems. U.S. Pat. Nos. 5,606,067 and 5,611,906 disclose the preparation of these compounds.

The above mentioned brightener systems, however, may exhibit one or more of the following limitations: poor ductility; limited low-current density coverage; poor leveling at low-current densities; burning at high current densities; or decreased receptivity to subsequent chromium deposits. It is therefore desirable to develop an brightener system for an acidic nickel plating bath that will produce an extremely ductile, leveled and highly bright deposit over a wide range of current densities.

SUMMARY OF THE INVENTION

Accordingly, it is a primary advantage of this invention to provide a new and improved brightener system for acidic nickel or nickel-alloy plating baths. It is a further object of this invention to provide a new and improved brightener system for acidic nickel or nickel-alloy plating baths that provides an extremely ductile, leveled and highly bright nickel deposit over a wide range of current densities without the need for alkyl sulfonates and pyridine-based brightening and leveling agents. Additional objectives and advantages of the invention will be set forth in part in the description that follows and in part will be apparent from description or learned by the practice of the invention. The advantages of the invention may be realized and attained by means of the instrumentalities and combinations particularly pointed out in the appended claims.

To achieve the foregoing objects, and in accordance with the purpose of the invention, as embodied and broadly described herein, the present invention provides, in a first aspect, a brightener for use in the electrodeposition of a nickel or nickel-alloy on a substrate, in which the brightener comprises an additive having the general formula:

$$H_2C{=}CHCH_2NR_1R_2 \text{ or}$$

$$[H_2C{=}CHCH_2N^+R_1R_2R_3]_nX^{n-}$$

wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion.

The present invention provides, in a second aspect, a process for the electrodeposition of a nickel or nickel-alloy coating on a metal substrate comprising immersing the metal substrate in a bath comprising nickel ions and an additive having the general formula $H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion.

In another aspect, the present invention provides an aqueous acidic plating bath for the electrodeposition of a nickel or nickel alloy deposit on a substrate comprising nickel ions; and an additive having the general formula $H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion.

In a further aspect, the invention provides an aqueous acidic plating bath for the electrodeposition of a nickel or nickel alloy deposit on a substrate comprising nickel ions; at least one Class I brightener; and an additive having the general formula $H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion.

The present invention also provides, in a further aspect, an aqueous acidic plating bath for the electrodeposition of a nickel or nickel alloy deposit on a substrate comprising nickel ions; at least one Class II brightener; and an additive having the general formula $H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting or hydrogen, methyl, ethyl, propyl, allyl, propyn, propanediol and combinations thereof; and $X^{n-}$ is an n-valent inorganic or organic anion.

In another aspect, the present invention provides an aqueous acidic plating bath for the electrodeposition of a nickel or nickel alloy deposit on a substrate comprising nickel ions; at least one Class I brightener; at least one Class II brightener; and an additive having the general formula $H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion.

In yet another aspect, the present invention provides an aqueous acidic plating bath for the electrodeposition of a nickel or nickel alloy deposit on a substrate comprising nickel ions; alloying metal ions; at least one Class I brightener; at least one Class II brightener; and an additive having the general formula $H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion.

The present invention provides an extremely ductile, leveled and highly bright nickel deposit over a wide range of current densities without the need for alkyl sulfonates and pyridine-based brightening and leveling agents.

DETAILED DESCRIPTION OF THE INVENTION

In accordance with the present invention, N-allyl substituted amines and their salts are employed as the main brightener and leveling additives in a nickel plating bath. The additives of the present invention are characterized by the following general formula:

$$H_2C{=}CHCH_2NR_1R_2 \text{ or}$$

$$[H_2C{=}CHCH_2N^+R_1R_2R_3]_nX^{n-}$$

wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion. Suitable n-valent anions include, but are not limited to chloride, bromide, fluoride, sulfate, acetate, and tetrafluoroborate. The N-allyl substituted amine or their salts are preferably present in a nickel plating bath at a concentration of from about 5 mg/l to about 160 mg/l; more preferably at a concentration of from about 5 mg/l to about 100 mg/l; and most preferably from about 6 mg/l to about 80 mg/l.

The use of N-allyl substituted amines or their salts has been found to produce a nickel deposit that is extremely ductile, exhibits excellent leveling, and is highly brilliant, i.e., bright, over a wide range of current densities. Further, the use of N-allyl substituted amines or their salts in acidic nickel baths produces such deposits without the need for alkyl sulfonates and pyridine based brighteners and leveling agents.

The N-allyl substituted amines and their salts act as Class II brighteners. Thus, N-allyl substituted amines are preferably used in combination with at least one Class I brightener.

Additionally, the baths of the present invention may include one or more secondary, or Class II, brighteners. Non-limiting examples of Class II brighteners suitable for use with the present invention include allyl alcohols, propargyl alcohols, butenediols or butynediols.

The nickel baths of the present invention may also include any other desirable additive, as are conventional in the use of nickel plating baths, including but not limited to wetting agents, anti-pitting agents, etc. A non-limiting example of a suitable wetting agent is sodium lauryl ethoxy sulfate or sodium lauryl ethoxy sulfonate.

The base electrolyte solution for the aqueous acidic nickel plating baths of the present invention include conventional aqueous acidic nickel electrolyte solutions known to those skilled in the art. Such baths contain free nickel ions. Typically, nickel ions are provided by nickel sulfate and/or nickel chloride. A typical acidic nickel plating solution suitable for use in the present invention is the Watts nickel plating bath. The baths of the invention are preferably Watts-type plating baths having the following general formula: 225-375 g/l nickel sulfate ($NiSO_4.6H_2O$); 60-120 g/l nickel chloride ($NiCl_2.6H_2O$); and 35-50 g/l boric acid ($H_3BO_3$). The pH of the baths is within the range of about 2 to about 5. Additionally, the baths according to the present invention include any conventional electrolyte solution, known to those skilled in the art, for plating nickel-alloys. Nickel-alloy plating solutions contain alloying metal ions. Any metal suitable for producing a nickel-alloy plate or coating on a substrate may be used. Preferably, the alloying metal ions are selected from the group consisting of iron, cobalt, tin, and zinc.

The present invention also includes a process for producing a nickel or nickel-alloy deposit on a substrate. A substrate is immersed in a nickel or nickel-alloy electrolyte solution that contains nickel ions and/or alloying metal ions, and also contains an additive having the general formula $H_2C{=}CHCH_2NR_1R_2$ or $[H_2C{=}CHCH_2N^+R_1R_2R_3]_nX^{n-}$ wherein $R_1$, $R_2$ and $R_3$ are selected from the functional groups consisting of hydrogen, methyl, ethyl, propyl, allyl, propyn, propanediol and combinations thereof; and $X^{n-}$ is an n-valent inorganic or organic anion. A current, sufficient to apply the desired amount of nickel or nickel-alloy, is applied to an anode that has been placed in the bath. Typically, nickel anodes are used as the anodes for the electrodeposition of nickel. The substrate to which the nickel or nickel-alloy deposit is applied acts as the cathode.

The nickel electroplating process may be carried out at temperatures of about 50° C. to about 70° C. with or without agitation. Preferably, the electroplating process is performed with agitation of the plating bath. Agitation may be provided by mechanical movement of the article being plated, air agitation of the solution/plating bath during electrodeposition, or both mechanical and air agitation.

The aqueous nickel plating baths of the present invention may be used to apply a nickel coating on a substrate. The substrate is preferably a metal or metal alloy. Non-limiting examples of suitable metal or metal alloys include iron, steel, aluminum, copper, brass and alloys thereof.

The following examples illustrate the inventive additives and plating baths of the invention.

EXAMPLES

Various brightening additives of the present invention were added to a Watts nickel plating bath having a composition set forth in the following table.

| Bath Component | Concentration |
|---|---|
| $NiSO_4.6H_2O$ | 300 g/l |
| $NiCl_2.6H_2O$ | 90 g/l |
| $H_3BO_3$ | 45 g/l |
| 1,2-benzisothizolin-3-one-1,1-dioxide, Na salt | 5 g/l |
| Propargyl alcohol ethoxylate | 3 mg/l |
| 2-butyne-1,4-diol | 10 mg/l |
| butynediol ethoxylate | 5 mg/l |
| 1-diethylamino-2-propyne | 12.5 mg/l |

The pH of the bath was adjusted to 4.0 using sulfuric acid.

Plating evaluations were conducted in a 267 ml heated Hull cell using N-allyl substituted amines or their salts as a brightener. Plating was conducted using a nickel anode and a brass cathode. Prior to plating, the brass Hull cell panels used as the cathode were anodically cleaned in an alkaline electrolyte. All plating was performed at 60° C. The brightening and leveling capabilities of nickel baths containing N-allyl substituted amines or their salts was evaluated based on plating tests under the above conditions. The results of the use of N-allyl substituted amines as brightening agents are given in the following table.

| Brightener | Concentration (mg/l) | Appearance (brightness) | Leveling |
|---|---|---|---|
| none | — | cloudy | poor |
| N-allylaniline | 20 | cloudy | poor |
| N-allylaniline | 40 | cloudy | poor |
| N-allylaniline | 80 | cloudy | poor |
| N-allylaniline | 160 | cloudy | poor |
| N-allylpyridine | 6 | bright | excellent |
| 1-allylimidizole | 20 | cloudy | fair |
| 1-allylimidizole | 40 | cloudy | fair |
| diallylamine | 20 | bright | excellent |
| triallylamine | 20 | bright | good |
| triallylamine | 40 | bright | excellent |
| diallyldimethyl ammonium chloride | 20 | slightly cloudy | fair |
| diallyldimethyl ammonium chloride | 40 | bright | good |
| diallyldimethyl ammonium chloride | 80 | bright | excellent |

Thus, it is apparent that there has been provided in accordance with this invention, an aqueous acidic nickel plating bath that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, the foregoing description is intended to embrace all such alternatives, modifications, and variations which fall within the spirit and scope of the appended claims.

What is claimed is:

1. An aqueous acidic plating bath for the electrodeposition of a nickel or nickel alloy deposit on a substrate comprising:

a) nickel ions; and b) an additive having the general formula:

$$H_2C{=}CHCH_2NR_1R_2 \text{ or}$$

$$[H_2C{=}CHCH_2N^+R_1\,R_2R_3]_nX^{n-}$$

wherein $R_1$, $R_2$ and $R_3$ are selected from the functional groups consisting of hydrogen, methyl, ethyl, propyl, allyl, propanediol and combinations thereof; and $X^{n-}$ is an n-valent inorganic or organic anion and n=1 or 2.

2. The bath according to claim 1 wherein $X^{n-}$ is an n-valent anion selected from the group of chloride, bromide, fluoride, sulfate, acetate, and tetrafluoroborate.

3. The aqueous acidic plating bath according to claim 1, wherein the additive comprises diallylamine.

4. The aqueous acidic plating bath according to claim 1, wherein the additive comprises triallylamine.

5. The aqueous acidic plating bath according to claim 1, wherein the additive comprises diallyldimethyl ammonium chloride.

6. The aqueous acidic plating bath according to claim 1, wherein the additive is present in an amount of from about 5 mg/l to about 160 mg/l.

7. The aqueous acidic plating bath according to claim 1, wherein the additive is present in an amount of from about 5 mg/l to about 100 mg/l.

8. The aqueous acidic plating bath according to claim 1, wherein the additive is present in an amount of from about 6 mg/l to about 80 mg/l.

9. An aqueous acidic plating bath for the electrodeposition of a nickel or nickel alloy deposit on a substrate comprising:

a) nickel ions;

b) at least one Class I brightener; and c) an additive having the general formula:

$$H_2C{=}CHCH_2NR_1R_2 \text{ or}$$

$$[H_2C{=}CHCH_2N^+R_1R_2R_3]_nX^{n-}$$

wherein $R_1$, $R_2$ and $R_3$ are selected from the functional groups consisting of hydrogen, methyl, ethyl, propyl, allyl, propanediol and combinations thereof; and $X^{n-}$ is an n-valent inorganic or organic anion and n=1 or 2.

10. An aqueous acidic plating bath for the electrodeposition of a nickel or nickel alloy deposit on a substrate comprising:

a) nickel ions;

b) at least one Class II brightener; and c) an additive having the general formula:

$$H_2C{=}CHCH_2NR_1R_2 \text{ or}$$

$$[H_2C{=}CHCH_2N^+R_1\,R_2R_3]_nX^{n-}$$

wherein $R_1$, $R_2$ and $R_3$ are selected from the functional groups consisting or hydrogen, methyl, ethyl, propyl, allyl, propyn, propanediol and combinations thereof; and $X^{n-}$ is an n-valent inorganic or organic anion and n=1 or 2.

11. An aqueous acidic plating bath for the electrodeposition of a nickel or nickel alloy deposit on a substrate comprising:

a) nickel ions;

b) at least one Class I brightener;

c) at least one Class II brightener; and d) an additive having the general formula:

$$H_2C{=}CHCH_2NR_1R_2 \text{ or}$$

$$[H_2C{=}CHCH_2N^+R_1\,R_2R_3]_nX^{n-}$$

wherein $R_1$, $R_2$ and $R_3$ are selected from the functional groups consisting or hydrogen, methyl, ethyl, propyl, allyl, propyn, propanediol and combinations thereof; and $X^{n-}$ is an n-valent inorganic or organic anion and n=1 or 2.

12. An aqueous acidic plating bath for the electrodeposition of a nickel or nickel alloy deposit on a substrate comprising:

a) nickel ions;

b) alloying metal ions;

c) at least one Class I brightener;

d) at least one Class II brightener; and e) an additive having the general formula:

$$H_2C{=}CHCH_2NR_1R_2 \text{ or}$$

$$[H_2C{=}CHCH_2N^+R_1\,R_2R_3]_nX^{n-}$$

wherein $R_1$, $R_2$ and $R_3$ are selected from the functional groups consisting or hydrogen, methyl, ethyl, propyl, allyl, propyn, propanediol and combinations thereof; and $X^{n-}$ is an n-valent inorganic or organic anion and n=1 or 2.

13. The bath according to claim 12 wherein the alloying metal ions are selected from the group of iron, cobalt, tin, and zinc.

14. A process for the electrodeposition of a nickel or nickel-alloy coating on a substrate, the process comprising:

immersing a metal substrate in a bath comprising nickel ions and an additive having the general formula:

$$H_2C{=}CHCH_2NR_1R_2 \text{ or}$$

$$[H_2C{=}CHCH_2N^+R_1R_2R_3]_nX^{n-}$$

wherein $R_1$, $R_2$ and $R_3$ are selected from the functional groups consisting of hydrogen, methyl, ethyl, propyl, allyl, propanediol and combinations thereof; and $X^{n-}$ is an n-valent inorganic or organic anion and n equals 1 or 2; and electrodepositing nickel onto the metal substrate.

15. The process according to claim 14 wherein $X^{n-}$ is selected from the group consisting of chloride, bromide, fluoride, sulfate, acetate, and tetrafluoroborate.

16. The process according to claim 14 wherein the bath further comprises alloying metal ions, and electrodepositing nickel onto the metal substrate comprises electrodepositing a nickel-alloy onto the metal substrate.

17. The process according to claim 16, wherein the alloying metal ions are selected from the group consisting of iron, cobalt, tin, and zinc.

18. The process according to claim 14, wherein the additive comprises diallylamine.

19. The process according to claim 14, wherein the additive comprises triallylamine.

20. The process according to claim 14, wherein the additive comprises diallyldimethyl ammonium chloride.

* * * * *